United States Patent [19]

Gundlach

[11] 4,416,537

[45] Nov. 22, 1983

[54] CLEANING SYSTEM

[75] Inventor: Robert W. Gundlach, Victor, N.Y.

[73] Assignee: Xerox Corporation, Stamford, Conn.

[21] Appl. No.: 266,396

[22] Filed: May 18, 1981

[51] Int. Cl.[3] ..... G03G 15/00

[52] U.S. Cl. ..... 355/15; 355/3 DD; 355/14 D; 118/652; 118/639; 430/125

[58] Field of Search ..... 355/15, 3 BE, 3 DD, 355/14 D; 118/653, 656, 657, 658, 661, 652; 354/318; 352/130; 430/125

[56] References Cited

U.S. PATENT DOCUMENTS

| | | | |
|---|---|---|---|
| 4,108,546 | 8/1978 | Rezanka | 355/15 |
| 4,258,372 | 3/1981 | Iishikawa | 355/3 DD X |
| 4,264,182 | 4/1981 | Mitchell | 355/3 DD |
| 4,294,534 | 10/1981 | Snelling | 355/3 R |

*Primary Examiner*—A. C. Prescott

[57] ABSTRACT

An apparatus in which a belt transports cleaning material into contact with particles adhering to a substantially rigid member. The belt is maintained at a preselected tension. In this way, the cleaning material and particles are compressed and space the belt from the rigid member.

15 Claims, 3 Drawing Figures

CLEANING SYSTEM

This invention relates to an electrophotographic printing machine, and more particularly concerns an improved cleaning system for use therein.

In electrophotographic printing, a photoconductive member is charged to sensitize the surface thereof. The charged photoconductive member is exposed to a light image of an original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing a developer material into contact therewith. Typical developer materials comprise a heat settable plastic powder, known in the art as toner particles, which adhere triboelectrically to coarser magnetic carrier granules, such as ferromagnetic granules. The toner particles are selected to have the appropriate charge relative to the electrostatic latent image recorded on the photoconductive surface. When the developer material is brought into contact with the latent image recorded on the photoconductive surface, the greater attractive force thereof causes the toner particles to transfer from the carrier granules to the electrostatic latent image.

Frequently, residual toner particles remaining adhering to the photoconductive surface after transfer from the photoconductive surface to a sheet of support material. Hereinbefore, ordinary cleaning devices such as webs, brushes or foam rollers, have not been entirely satisfactory in cleaning residual toner particles from the photoconductive surface. One of the more attractive efforts for cleaning particles from the photoconductive surface has been to use a rotating magnet enclosed in a stationary, non-magnetic shell or, alternatively, to utilize stationary magnets enclosed within a rotating, non-magnetic shell. This system attracts carrier granules which, in turn, attract the residual toner particles from the photoconductive surface thereto. However, cleaning systems of this type are presently rather costly and complex in order to achieve the desired cleaning efficiency. Various types of techniques have hereinbefore been employed to clean photoconductive surfaces. The following disclosures appear to be relevant:

U.S. Pat. No. 3,276,896, Patentee: Fisher, Issued: Oct. 4, 1966,

U.S. Pat. No. 3,580,673, Patentee: Yang, Issued: May 25, 1971,

U.S. Pat. No. 3,713,736, Patentee: Sargis, Issued: Jan. 30, 1973,

U.S. Pat. No. 4,013,041, Patentee: Armstrong et al., Issued: Mar. 22, 1977,

U.S. Pat. No. 4,096,826, Patentee: Stange, Issued: June 27, 1978,

U.S. Pat. No. 4,108,546, Patentee: Rezanka, Issued: Aug. 22, 1978,

Co-pending application Ser. No. 111,450, Applicant: Kopko et al., Filed: Jan. 11, 1980, Co-pending application Ser. No. 155,889, Filed: June 2, 1980, Applicant: Hays, Co-pending application Ser. No. 169,543, Filed: July 17, 1980, Applicant: Hatch.

Co-pending application Ser. No. 180,791, Filed: Aug. 25, 1980, Applicant: Seanor.

The pertinent portions of the foregoing disclosures may be briefly summarized as follows:

Fisher discloses a washing roller having a flexible photoreceptor guided thereover by a transport roller. An extended nip is formed about the washing roller.

Yang describes an apparatus for cleaning toner particles from a recording surface. The apparatus includes a rotatably mounted non-magnetic cylindrical member housing a permanent bar magnet. The cylindrical magnet moves magnetic beads into contact with the recording surface. An electrical bias opposed in polarity to the polarity of the toner particles is applied thereto. The electrical bias is sufficient to attract the toner particles to the cleaning beads. A conductive roll is positioned in contact with the magnetic beads. The roll is electrically biased to the same polarity as the cylindrical member with the magnitude thereof being sufficiently high to attract the toner particles from the cleaning beads thereto.

Sargis discloses a toner removal apparatus including a container partially filled with magnetizable particles. A hollow cleaning roller is mounted therein for rotation about a permanent magnet. Toner particles clinging to the photoconductive belt are attracted by triboelectric forces to the magnetizable particles covering the surface of the cleaning roller. A pair of auxiliary rollers are disposed in the container to dissipate the toner laden magnetic particles throughout the particles in the container. The cleaning roller may be electrically biased to attract the toner particles to the cleaning roller.

Armstrong et al. discloses an electrophotographic printing machine having a magnetic brush developer roller contacting one side of a flexible photoconductive belt. As shown in FIG. 3, guide rollers maintain a portion of the belt in a slackened condition so that the belt is capable of moving freely toward and away from the developer roller in response to the varying contours thereof.

Stange discloses a magnetic brush development system in which a deflection device moves the image bearing surface of a flexible member into contact with the magnetic fibers of the magnetic brush developer assembly.

Rezanka describes an extended cleaning nip through the use of a cleaning web deformably engaging a photoconductive drum.

Kopko et al. describes an electrophotographic printing machine in which developer material on a developer roller deforms a tensioned photoconductive belt so as to space the developer roller from the belt.

In Hays, an insulating two component developer material is contained in a highly agitated development zone. This permits the continual development of high quality images including solid areas.

Hatch discloses an electrophotographic printing machine in which developer material on a developer roller spaces the photoconductive belt therefrom. The thickness of the layer of developer material on the developer roller is adjustable to control the spacing between the photoconductive belt and the developer roller.

Seanor describes a rotating tube having stationary magnets disposed interiorally thereof. Magnetic particles are attracted to the exterior circumferential surface of the tube and advanced into a cleaning zone. The photoconductive belt is maintained at a tension such that the cleaning material and toner particles adhering to the photoconductive belt are compressed deflecting the photoconductive belt through an extended arc to define an extended cleaning zone.

In accordance with the features of the present invention, there is provided an apparatus for removing particles from a substantially rigid member. Flexible means, positioned closely adjacent to the rigid member defining a cleaning zone therebetween, transport a cleaning material into contact with the particles adhering to the rigid member. Means are provided for maintaining the flexible means at a pre-selected tension of sufficient magnitude to compress the material and particles in the cleaning zone and to space the flexible means from the rigid member.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
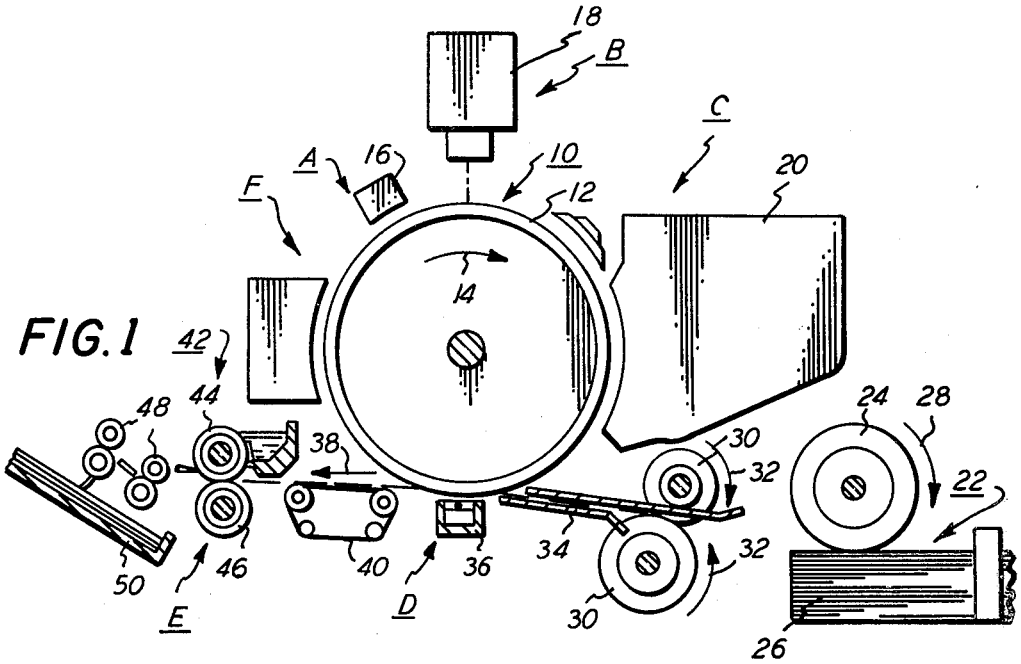
FIG. 1 is a schematic elevational view depicting an electrophotographic printing machine incorporating the features of the present invention therein.

For a general understanding of the illustrative electrophotographic printing machine incorporating the features of the present invention, reference is made to the drawings. In the drawings, like reference numerals have been used throughout to designate identical elements. FIG. 1 schematically depicts the various components of an electrophotographic printing machine incorporating the cleaning system of the present invention therein. Although this cleaning system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the illustrative electrophotographic printing machine employs a drum 10 having a photoconductive surface 12, e.g. a selenium alloy, adhering to a conductive substrate, e.g. aluminum. Drum 10 moves in the direction of arrow 14 to advance the photoconductive surface sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through exposure station B. Exposure station B includes an exposure system, indicated generally by the reference numeral 18. At exposure station B, an original document is positioned face down upon a transparent platen. Light rays reflected from the original document are transmitted through a lens to form a light image thereof. The light image is focused onto the charged portion of the photoconductive surface 12 to selectively dissipate the charge thereon. This records an electrostatic latent image on photoconductive surface 12 which corresponds to the informational areas contained within the original document.

Thereafter, drum 10 advances the electrostatic latent image recorded on photoconductive surface 12 to development station C. At development station C, a magnetic brush development system, indicated generally by the reference numeral 20, advances developer material into contact with the electrostatic latent image. The latent image attracts the toner particles from the carrier granules of the developer material to form a toner powder image on photoconductive surface 12 of drum 10.

Drum 10 then advances the toner powder image to transfer station D. At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of the stack of sheets 26. Feed roll 24 rotates in the direction of arrow 28 so as to advance the uppermost sheet into the nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 so that the toner powder image developed thereon contacts the advancing sheet at transfer station D.

Preferably, transfer station D includes a corona generating device 36 which sprays ions onto the backside of the sheet. This attracts the toner powder image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred toner powder image to the sheet. Preferably, fuser assembly 42 includes a heated fuser roller 44 and a back-up roller 46. The sheet passes between fuser roller 44 and back-up roller 46 with the toner powder image contacting fuser roller 44. In this manner, the toner powder image is permanently affixed to the sheet. After fusing, forwarding rollers 48 advance the sheet to catch tray 50 for subsequent removal from the printing machine by the operator.

Invariably, after the sheet of support material is separated from the photoconductive surface 12 of drum 10, some residual toner particles remain adhering thereto. These residual toner particles are removed from photoconductive surface 12 at cleaning station F. Preferably, cleaning station F includes a cleaning system indicated generally by the reference numeral 52, which attracts toner particles from photoconductive surface 12 of belt 10 thereto. The detailed structure of cleaning system 52 will be described hereinafter with reference to FIGS. 2 and 3. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes for the present application to illustrate the general operation of an electrophotographic printing machine incorporating the features of the present invention therein.

Figure 2:
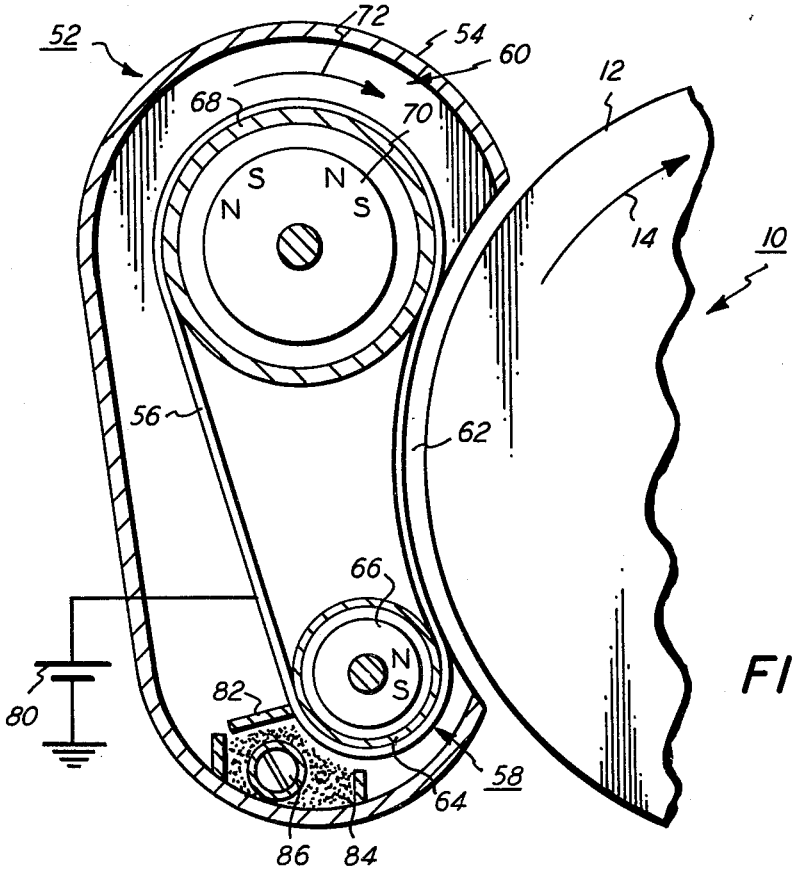
FIG. 2 is an elevational view illustrating the cleaning system of the FIG. 1 printing machine.

Referring now to the specific subject matter of the present invention, as shown in FIG. 2, cleaning system 52 inludes a housing 54 defining a chamber for storing a supply of cleaning material therein. Preferably, the cleaning material is magnetic carrier granules. Belt 56 is entrained about opposed, spaced magnetic rollers, indicated generally by the reference numerals 58 and 60. Magnetic rollers 58 and 60 are substantially identical to one another with magnetic roller 60 being located at the entrance to the cleaning zone 62 and magnetic roller 58 being located at the exit of cleaning zone 62. Preferably, magnetic roller 58 is mounted resiliently to tension belt 56. The details of the tensioning system will be described hereinafter with reference to FIG. 3. Magnetic roller 58 includes a non-magnetic tubular roll 64 journaled for rotation. By way of example, tubular roll 64 may be made from aluminum. An elongated magnet 66 is positioned concentrically within tubular roll 64 being spaced from the interior circumferential surface thereof. Magnet 66 has a plurality of magnetic poles present thereon. Preferably, magnet 66 is made from barium ferrite. No magnetic poles are impressed on magnet 66 in the region adjacent cleaning zone 62. In this way, the magnetic poles generate a strong magnetic field in the cleaning zone exit and a weak magnetic field or substantially no magnetic field in the cleaning zone itself. Similarly, magnetic roller 60 includes a tubular roll 68 having an elongated magnet 70 disposed concentrically therein and spaced therefrom. Tubular roll 68 is also made from aluminum with magnet 70 being made from barium ferrite. Magnet 70 has a plurality of magnetic poles impressed thereon with the region adjacent the cleaning zone 62 having substantially no magnet poles. Thus, the entrance region of the cleaning zone has a strong magnetic field with the cleaning zone itself having a weak magnetic field. It is thus clear that both the entrance and exit regions to the cleaning zone have strong magnetic fields with the cleaning zone itself having a substantially weaker magnetic field. Preferably, the cleaning zone is a magnetically field free region. A motor (not shown) rotates tubular member 68 to advance belt 56 in the direction of arrow 72. Tubular member 64 is journaled to rotate freely and acts as an idler roller. As belt 56 moves in the direction of arrow 72, cleaning material is attracted to the surface thereof. The cleaning material is advanced on belt 56 into contact with the residual toner particles adhering to photoconductive surface 12 of drum 10 in cleaning zone 62.

When the printing machine is energized, belt 56 is tensioned to a sufficient magnitude such that the cleaning material and residual toner particles are compressed spacing belt 56 a distance of about 0.05 centimeters from drum 10. Magnetic roller 58 has one end thereof mounted pivotably. When the printing machine is de-energized, a solenoid (not shown) pivots magnetic roller 58 about 0.65 centimeters to space belt 56 a distance of about 0.15 centimeters from drum 10.

One skilled in the art will appreciate that a flat photoconductive plate may be employed in lieu of a photoconductive drum. In the event the printing machine uses a flat photoconductive plate, a resilient pad is mounted interiorly of belt 56. The pad engages the interior surface of belt 56 opposed from the flat photoconductive plate. A solenoid is coupled to the resilient pad. Actuation of the solenoid tensions belt 56 sufficiently so that the cleaning material and residual toner particles space belt 56 a distance of about 0.05 centimeters from the flat photoconductive plate. De-actuation of the solenoid spaces belt 56 a distance of about 0.15 centimeters from the flat photoconductive plate.

Voltage source 80 is coupled to belt 56 and applies a D.C. electrical field to the space between belt 56 and photoconductive surface 12. Preferably, the polarity of this field is opposite to the toner particles adhering to photoconductive surface 12 of drum 10 and of a magnitude sufficient to attract the toner particles from photoconductive surface 12 to the magnetic particles adhering to belt 56. These magnetic particles are selected so that the toner particles have a triboelectric affinity thereto. By way of example, voltage source 80 electrically biases belt 56 to a voltage level ranging from about 100 to about 300 volts.

As belt 56 moves in the direction of arrow 52 a brush of cleaning material is formed on the surface thereof. The brush of cleaning material advances into contact with drum 10 in cleaning zone 62. The cleaning material and residual toner particles are compressed in cleaning zone 62. In this way, belt 56 is spaced from photoconductive surface 12 of drum 10. The toner particles adhering to the photoconductive surface 12 of drum 10 are attracted to the magnetic cleaning particles. Thus, in the cleaning zone, the toner particles are attracted from photoconductive surface 12 of drum 10 to the magnetic cleaning particles adhering to belt 56. In this way, the magnetic cleaning particles of the cleaning material remove the residual toner particles adhering to the photoconductive surface 12 of drum 10. Belt 56 is made preferably from a flexible conductive web such as Mylar having a conductive textured coating thereon.

A metering blade 82 is located closely adjacent to belt 56 for removing the toner particles therefrom. Metering blade 82 shears the toner particles from belt 56 into housing 84. Housing 84 has a helical auger 86 disposed therein. Helical auger 86 advances these toner particles to a remote station for subsequent reuse in the printing machine development system. By way of example, blade 82 may be made from sheet metal extending across the width of belt 56.

Figure 3:
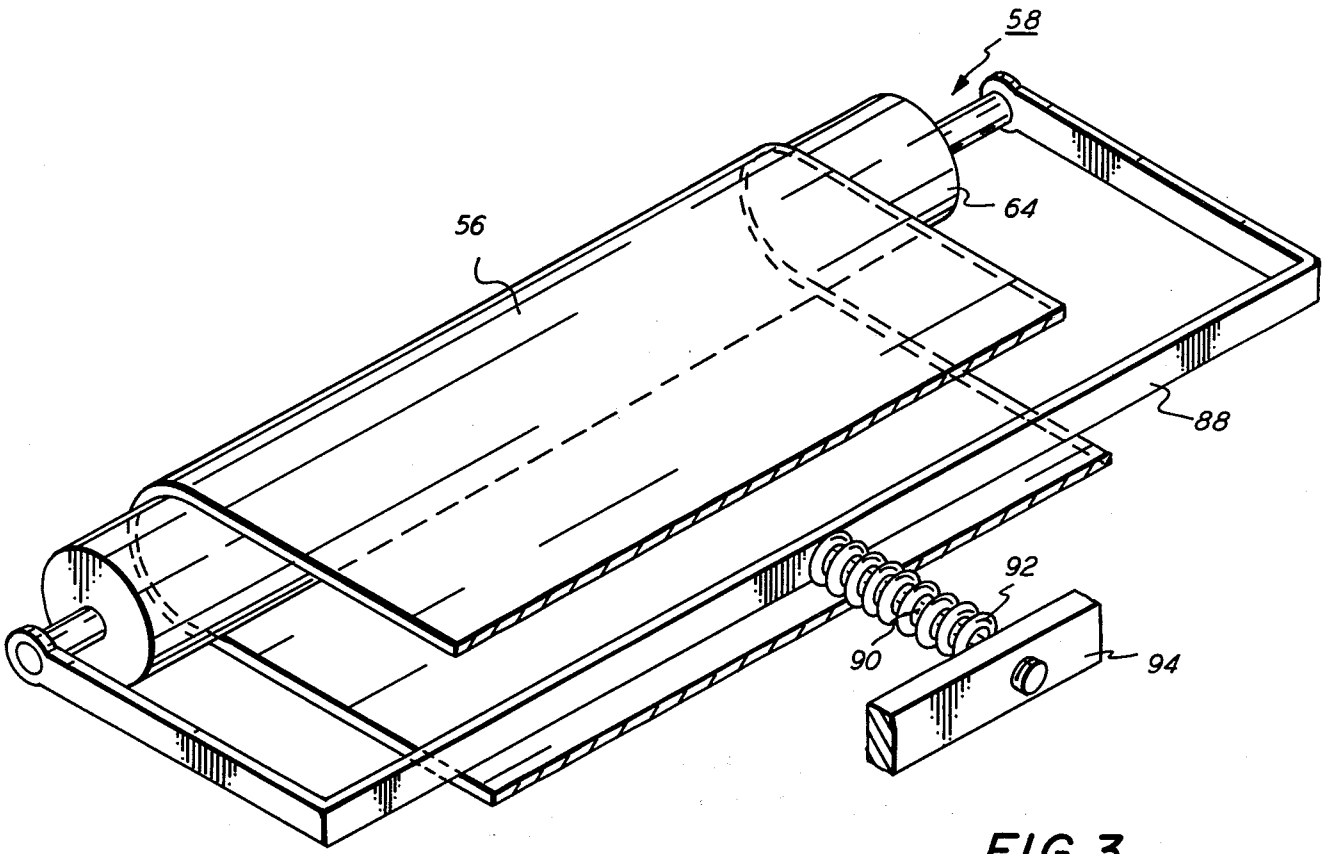
FIG. 3 is a fragmentary perspective view showing the belt tensioning arrangement of the FIG. 2 cleaning system.

Turning now to FIG. 3, there is shown the detailed structure of the system for tensioning belt 56. As shown thereat, tubular member 64 of roller 58 is mounted in suitable bearings in a yoke, indicated generally by the reference numeral 88. Preferably, yoke 88 includes a U-shaped portion supporting roller 64 and a rod 90 secured to the midpoint of the cross member of U-shaped member 88. Coil spring 92 is wrapped around rod 90. Rod 90 is mounted slidably in frame 94 secured fixedly to housing 54 of cleaning system 52. Spring 92 is designed to have the appropriate spring constant such that when placed under the desired compression, belt 56 is tensioned to the desired magnitude. Belt 56 is maintained under a sufficiently low tension to enable the cleaning material and toner particles disposed in cleaning zone 62 (FIG. 2) to deflect belt 56 through an arc spacing belt 56 about 0.05 centimeters from photoconductive surface 12. This extended arc comprises cleaning zone 62 (FIG. 2).

In recapitulation, it is clear that the cleaning system of the present invention has a belt positioned closely adjacent to a rigid photoconductive member so as to transport cleaning material into contact with the residual toner particles adhering thereto. The belt is maintained at a pre-selected tension of sufficient magnitude to enable the cleaning material and toner particles in the cleaning zone to deflect the belt thereat. In this manner, the cleaning material and residual toner particles are compressed and highly agitated while the belt deflects to define an extended cleaning zone which significantly improves cleaning of the photoconductive surface.

It is, therefore, evident that there has been provided in accordance with the present invention, an apparatus for cleaning a photoconductive surface that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for removing particles from a substantially rigid member, including:

flexible means, positioned closely adjacent to the rigid member defining a cleaning zone therebetween, for transporting a cleaning material into contact with the particles adhering to the rigid member;

means for maintaining said flexible means at a preselected tension of sufficient magnitude to compress the cleaning material and particles in the cleaning zone and to space said flexible means from the rigid member; and means for moving said belt toward the rigid member upon actuation of the apparatus and away from the rigid member upon de-actuation of the apparatus.

2. An apparatus for removing particles from a substantially rigid member, said apparatus comprising:

a flexible particle removing member; and a pair of support members for said flexible member, said support members being positioned relative to said rigid member such that a portion of said flexible member intermediate said pair of support members is spaced from said substantially rigid member and substantially parallel thereto to thereby define an elongated cleaning zone therebetween.

3. Apparatus according to claim 2 wherein said flexible member comprises an endless belt entrained about said pair of support members.

4. Apparatus according to claim 3 further comprising means for electrically biasing said endless belt.

5. Apparatus according to claim 4 wherein said endless belt is fabricated from a conductive material.

6. Apparatus according to claim 5 further comprising means for removing the particles from said belt.

7. Apparatus according to claim 6 further comprising means for collecting the particles removed from said belt and means to remove particles to a remote location.

8. Apparatus according to claim 7 further comprising means for attracting cleaning material to said belt.

9. Apparatus according to claim 8 further comprising belt moving means for moving said belt towards said rigid member upon actuation of said apparatus for compressing the cleaning material attracted to said belt between said belt and said rigid member and away from the rigid member upon de-actuation of the apparatus.

10. An electrophotographic printing machine of the type having residual toner particles adhering to a substantially rigid photoconductive member wherein the improvement includes:

a flexible particle removing member; and a pair of support members for said flexible member, said support members being positioned relative to said rigid photoconductive member such that a portion of said flexible member intermediate said pair of support members is spaced from said substantially rigid photoconductive member and substantially parallel thereto to thereby define an elongated cleaning zone therebetween.

11. A printing machine according to claim 10 wherein said flexible member comprises an endless belt entrained about said pair of support members.

12. A printing machine according to claim 11 further comprising means for electrically biasing said endless belt.

13. A printing machine according to claim 12 wheren said endless belt is fabricated from a conductive material.

14. A printing machine according to claim 13 further comprising means for attracting cleaning material to said belt.

15. A printing machine according to claim 14 further comprising belt moving means for moving said belt toward said rigid member upon actuation of said apparatus for compressing the cleaning material attracted to said belt between said belt and said rigid member and away from the rigid member upon de-actuation of the apparatus.

* * * * *